US009802299B2

(12) United States Patent
Hung

(10) Patent No.: US 9,802,299 B2
(45) Date of Patent: Oct. 31, 2017

(54) TORSION-DETECTING PNEUMATIC IMPACT TOOL

(71) Applicant: SOARTEC INDUSTRIAL CORP., Taichung (TW)

(72) Inventor: Pei-Chin Hung, Taichung (TW)

(73) Assignee: SOARTEC INDUSTRIAL CORP., Taichung (TW)

( * ) Notice: Subject to any disclaimer, the term of this patent is extended or adjusted under 35 U.S.C. 154(b) by 434 days.

(21) Appl. No.: 14/667,102

(22) Filed: Mar. 24, 2015

(65) Prior Publication Data

US 2016/0282245 A1 Sep. 29, 2016

(51) Int. Cl.

| | |
|---|---|
| ***B25B 21/02*** | (2006.01) |
| ***B25B 23/147*** | (2006.01) |
| *B25B 23/145* | (2006.01) |
| *B25F 5/02* | (2006.01) |

(52) U.S. Cl.

CPC ..... *B25B 21/02* (2013.01); *B25B 23/147* (2013.01); *B25B 23/1453* (2013.01); *B25B 23/1456* (2013.01); *B25B 23/145* (2013.01); *B25F 5/02* (2013.01)

(58) Field of Classification Search

CPC ... B25B 23/14; B25B 23/145; B25B 23/1456; B25B 23/147; B25B 23/1475; B25B 23/1405; B25B 21/02; B25B 21/026; B25F 5/00; B25F 5/001; B25F 5/003; B25F 5/02

USPC ... 173/2, 176, 183, 93, 93.5, 93.6, 181, 217; 318/432, 434, 811; 310/47, 50, 239, 244; 73/862.21, 862.23, 862.31, 862.35

See application file for complete search history.

(56) References Cited

U.S. PATENT DOCUMENTS

| | | | | |
|---|---|---|---|---|
| 4,285,112 A * | 8/1981 | Eshghy | B23P 19/066 | 173/183 |
| 4,609,089 A * | 9/1986 | Kobayashi | B25B 23/1453 | 173/183 |
| 4,648,282 A * | 3/1987 | Alender | B25B 23/1456 | 173/183 |
| 6,848,516 B2 * | 2/2005 | Giardino | B25B 23/1405 | 173/176 |
| 6,968,908 B2 * | 11/2005 | Tokunaga | B25B 21/02 | 173/181 |
| 6,978,846 B2 * | 12/2005 | Kawai | B23P 19/066 | 173/176 |

(Continued)

*Primary Examiner* — Scott A. Smith

(74) *Attorney, Agent, or Firm* — Muncy, Geissler, Olds & Lowe, P.C.

(57) ABSTRACT

A torsion-detecting pneumatic impact tool is provided. A hammering set having at least one hammering block and a rotating portion which is connected with each hammering block. A transmission shaft penetrates through each the hammering block. A torsion detecting unit includes a marking piece which has a plurality of blocks, at least two sensors which detect the marking piece and an processing unit which is electrically connected with each the sensor. The hammering set, the marking piece, and the rotating assembly rotating synchronously. When each the hammering block swing strikes the transmission shaft in a direction, the hammering set and the marking piece rotate reversely slightly because of the counterforce of swing strike. When the marking piece rotates reversely, the processing unit receives a signal of a degree of rotation of the blocks detected by the at least two sensors and computes a torsion value.

10 Claims, 4 Drawing Sheets

(56) References Cited

U.S. PATENT DOCUMENTS

| | | | | |
|---|---|---|---|---|
| 7,036,703 | B2 * | 5/2006 | Grazioli | B25B 27/0085 173/176 |
| 7,562,720 | B2 * | 7/2009 | Seith | B25B 21/026 173/176 |
| 7,600,577 | B2 * | 10/2009 | Simm | H02K 11/215 173/176 |
| 7,770,658 | B2 * | 8/2010 | Ito | B23P 19/066 173/1 |
| 8,607,892 | B2 * | 12/2013 | Iimura | B25B 21/02 173/181 |
| 8,616,299 | B2 * | 12/2013 | Ichikawa | H02P 6/06 173/176 |
| 8,678,106 | B2 * | 3/2014 | Matsunaga | B25B 21/008 173/176 |

* cited by examiner

TORSION-DETECTING PNEUMATIC IMPACT TOOL

BACKGROUND OF THE INVENTION

Field of the Invention

The present invention relates to a pneumatic impact tool, and more particularly to a torsion-detecting pneumatic impact tool.

Description of the Prior Art

Usually, a pneumatic impact tool drives a transmission shaft to rotate and provide greater torsion through a hammering block of a hammering assembly swing striking intermittently. When the pneumatic impact tool is designed, the application perspectives are taken into consideration to determine the greatest rotation speed and the greatest torsion value and to protect a user's safety. However, regarding the pneumatic impact tool of the prior art, the user only knows the greatest value of the pneumatic impact tool, for example, the greatest torsion value is 610 Nm, instead of the information in actual practice, for example, normal rotation, reverse rotation or the torsion value. The user uses the pneumatic impact tool according to his/her experiences, and an inexperienced user is uncertain about the more appropriate output power (torsion); therefore, members of the pneumatic impact tool are easily damaged, and what is worse is that the user may get hurt.

The present invention has arisen to mitigate and/or obviate the afore-described disadvantages.

SUMMARY OF THE INVENTION

The major object of the present invention is to provide an torsion-detecting pneumatic impact tool, which detects a torsion value when a pneumatic impact tool is operated, to let a user know a more appropriate torsion value for a driven object when s/he operates the pneumatic impact tool so as to prevent the driven object from overload. The present invention not only provides preferable use efficiency but also protects the security of the driven object and the user.

To achieve the above and other objects, a torsion-detecting pneumatic impact tool of the present invention is provided, including a main body, a transmission shaft and a torsion detecting unit. A rotating assembly and a hammering set are disposed in the main body. The hammering set has at least one hammering block and a rotating portion which is connected with each hammering block, and each hammering block, the rotating portion and the rotating assembly rotate synchronously. The transmission shaft penetrates through each hammering block and is actuated intermittently by the hammering block's swing strike. The torsion detecting unit has a marking piece which is formed with a plurality of blocks, at least two sensors which detect the marking piece and an processing unit which is electrically connected with each sensor, and the marking piece and the rotating assembly rotate synchronously. Wherein, when each hammering block swing strikes the transmission shaft in a direction, each hammering block, the rotating portion and the marking piece rotate reversely slightly because of a counterforce of swing strike. The processing unit receives a signal of a degree of rotation of the blocks detected by the at least two sensors and computes a torsion value.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
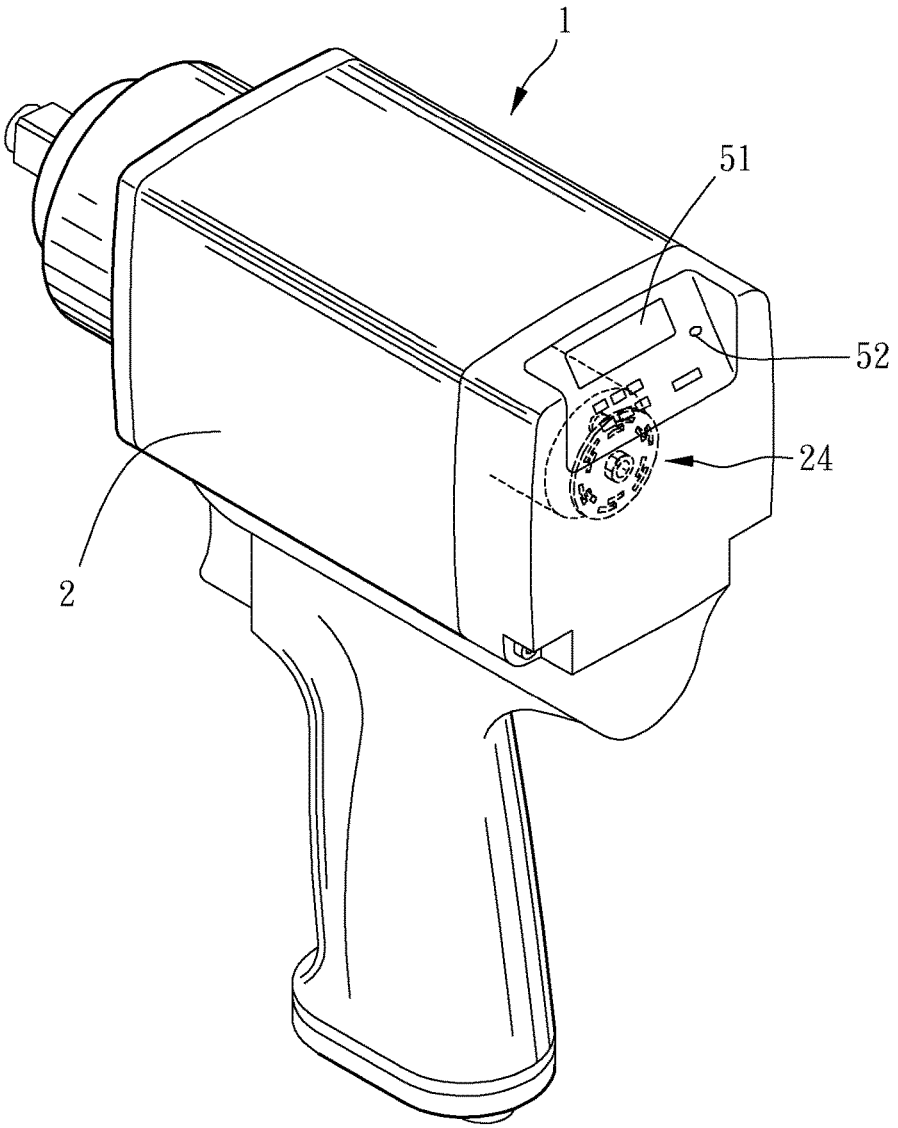
FIG. 1 is a perspective view of a preferred embodiment of the present invention.
Figure 2:
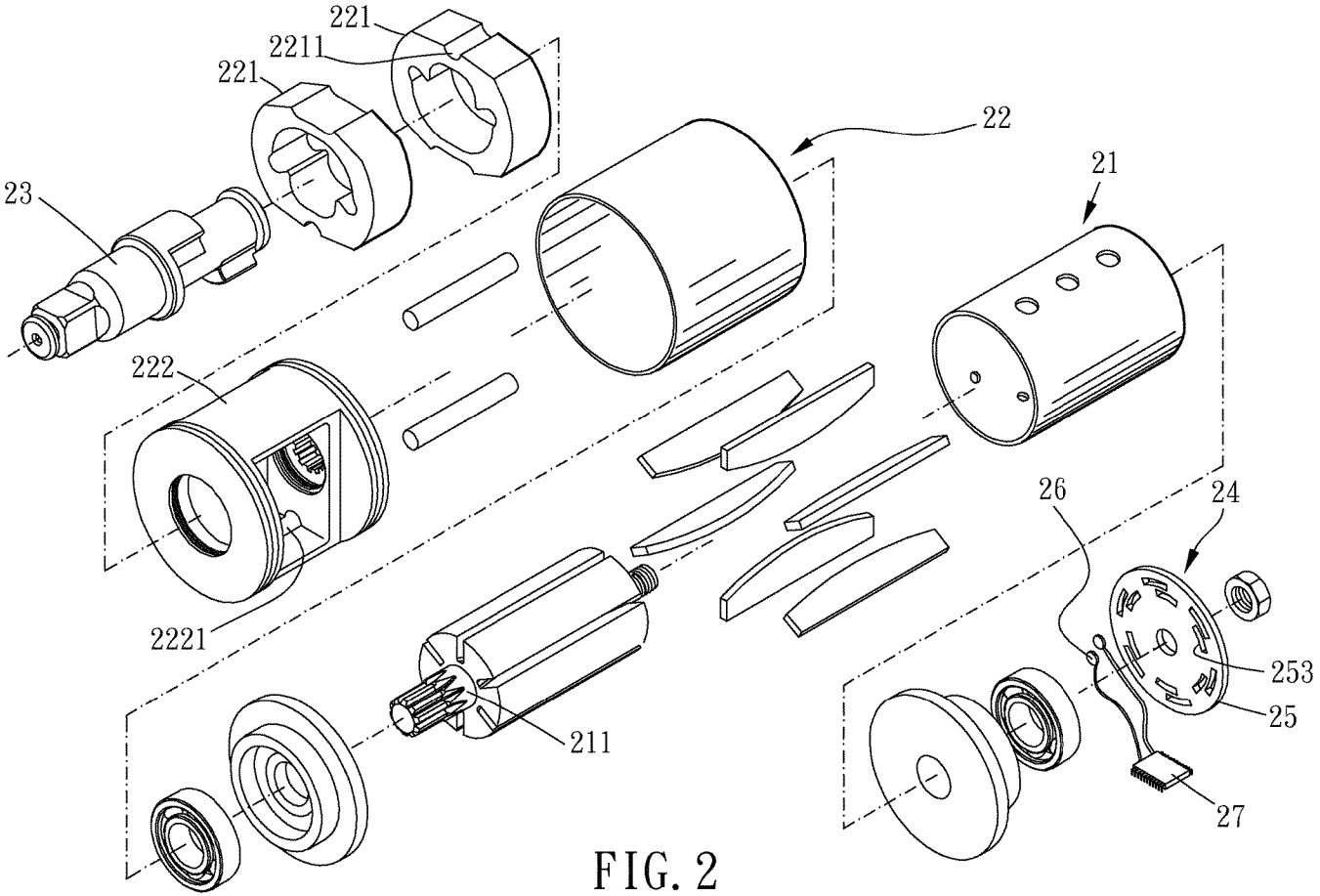
FIG. 2 is a breakdown drawing of the preferred embodiment of the present invention.
Figure 3:
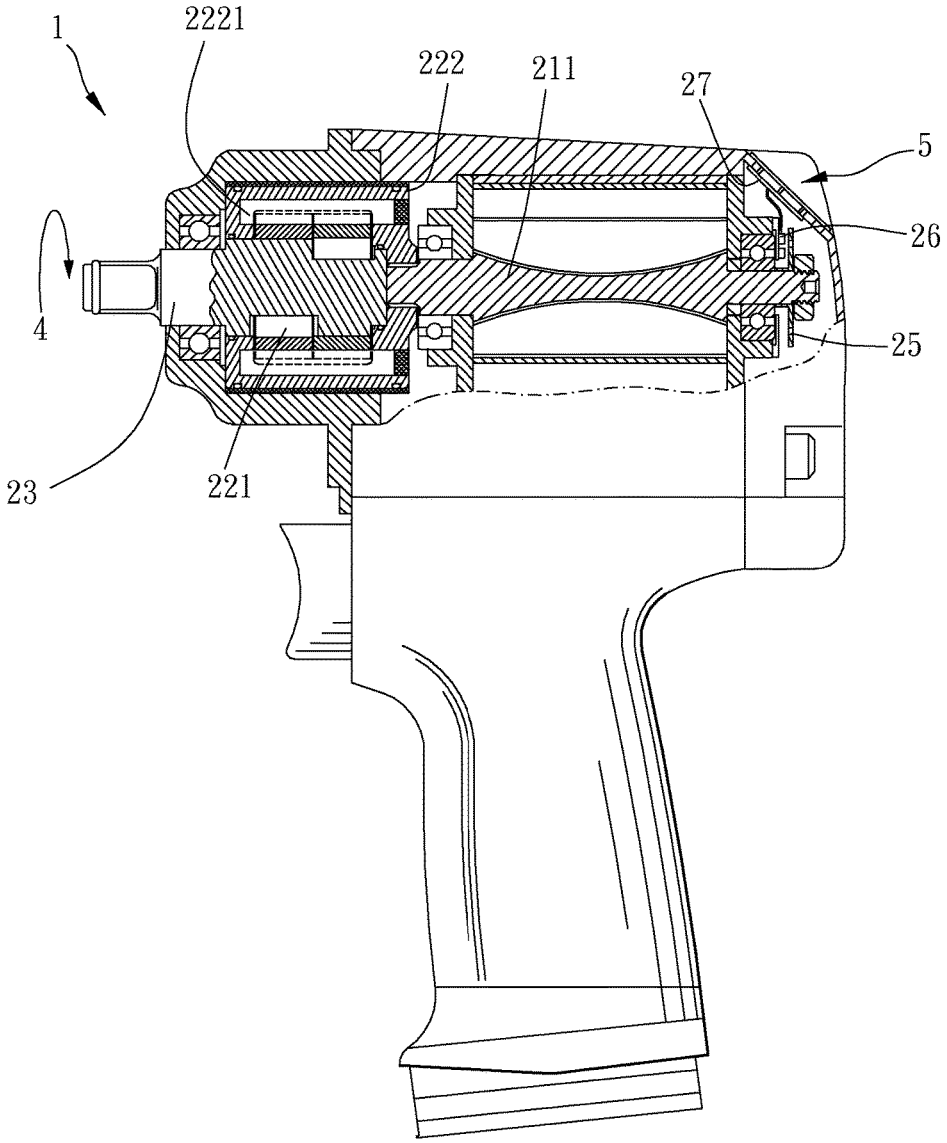
FIG. 3 is a side cross-sectional view of the preferred embodiment of the present invention.

The present invention will be clearer from the following description when viewed together with the accompanying drawings, which show, for purpose of illustrations only, the preferred embodiment in accordance with the present invention.

Please refer to FIG. 1 to FIG. 4 for a preferred embodiment of the present invention. A torsion-detecting pneumatic impact tool 1 includes a main body 2, a transmission shaft 23 and a torsion detecting unit 24.

A rotating assembly 21 and a hammering set 22 are disposed in the main body 2. The hammering set 22 has at least one hammering block 221 and a rotating portion 222 which is connected with each hammering block 221, and each hammering block 221, the rotating portion 222 and the rotating assembly 21 rotate synchronously. The transmission shaft 23 penetrates through each hammering block 221 and is actuated intermittently by swing strike of the hammering block 221. The torsion detecting unit 24 has a marking piece 25 which is formed with a plurality of blocks 252, at least two sensors 26 which detect the marking piece 25 and an processing unit 27 which is electrically connected with each sensor 26, and the marking piece 25 and the rotating assembly 21 rotate synchronously. Wherein, when each hammering block 221 swing strikes the transmission shaft 23 in a direction, each hammering block 221, the rotating portion 222 and the marking piece 25 rotate reversely slightly because of a counterforce of swing strike, when the marking piece 25 rotates reversely, the processing unit 27 receives a signal of a degree of rotation of the blocks 252 detected by the at least two sensors 26 and computes a torsion value.

Specifically, a plurality of encode groups 251 are annularly formed on the marking piece 25 and repeatedly arranged along the marking piece 25, and each encode group 251 has a part of the blocks 252 which are encoded in a first direction 3. In other words, characteristics of the blocks 252 are correspondingly encoded, along the first direction 3 in sequence, into codes to build a code table. When the marking piece 25 rotates in a second direction 4, the processing unit 27 determines whether the second direction 4 and the first direction 3 are the same or not according to the coding sequence the processing unit 27 receives. In this embodiment, each sensor 26 is a light sensor, and the marking piece 25 is a grating plate; that is, the marking piece 25 is formed with a plurality of through holes 253, and the through holes 253 partially overlap radially to define the blocks 252 so as to be detected by the sensor 26.

Figure 4:
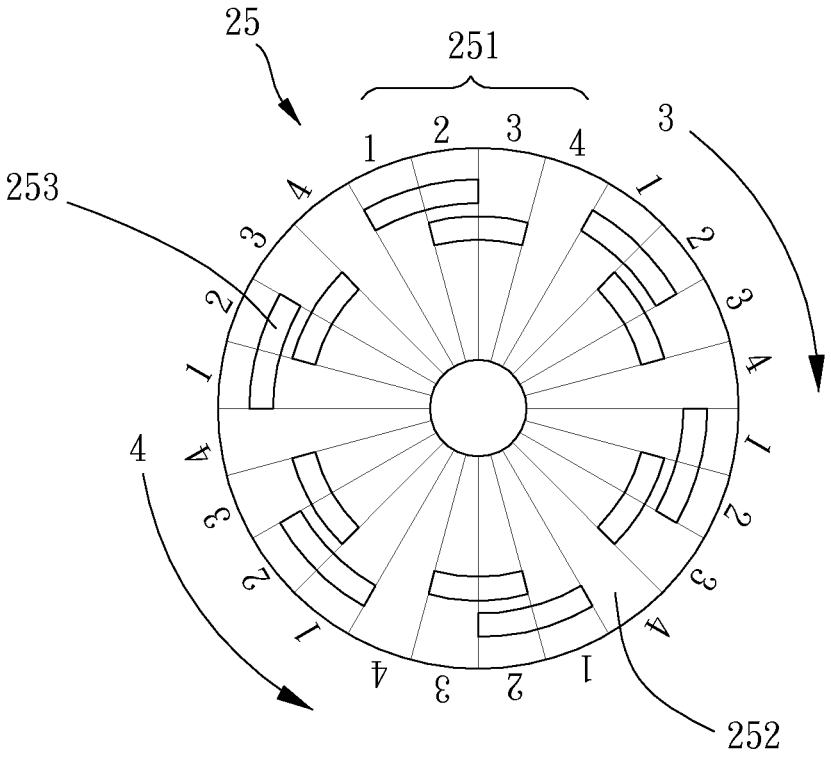
FIG. 4 is a drawing illustrating encoding principle according to the preferred embodiment of the present invention.
Figure 4A:
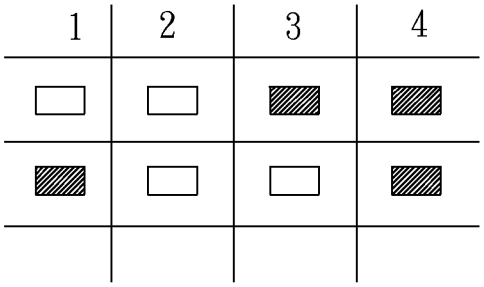
FIG. 4A is a drawing showing encoded codes in correspondence with FIG. 4.

More specifically, please refer to FIG. 4 and FIG. 4A for this embodiment. Six said through holes 253 are arranged along a phantom inner circle and six said through holes 253 are arranged along a phantom outer circle on the marking piece 25, respectively. Taking one said encode group as an example, when the block 252 has only one said through hole 253 arranged along the phantom outer circle, the block 252 is encoded as code 1; when the block 252 has two said through holes 253 arranged along the phantom inner and outer circles respectively, the block 252 is encoded as code 2; when the block 252 has only one said through hole 253 arranged along the phantom inner circle, the block 252 is encoded as code 3; and when the block 252 has none of the through holes, the block 252 is encoded as code 4. When the first direction 3 is clockwise, the encode group 251 is arranged in sequence (1→2→3→4); therefore, when the processing unit 27 receives the coding sequence (4→3→2→1), the second direction 4 of the marking piece 25 rotating can be known to be counter-clockwise. The at least two sensors 26 are, preferably, disposed on the same radial extension line respectively to detect the changes of the blocks 252 synchronously. Aside from determining rotation direction, the time of the processing unit 27 receiving coding changes can be used to measure a rotation speed of the rotating assembly 21.

In this embodiment, the marking piece 25 has six said encode groups 251, and each block 252 represents a 15-degree angle respectively. When the hammering block 221, the rotating portion 222 and the marking piece 25 rotate clockwise and rotate reversely slightly because of the counterforce of swing strike, the coding sequence which the processing unit 27 receives changes. For example, originally, the clockwise-encoding sequence without strike which is 1→2→3→4 changes into a sequence 1→2→2→3→4. That is, the hammering block 221 swingingly strikes the transmission shaft 23 in a position corresponding to the block 252 encoded as code 3, to make the marking piece 25 rotate reversely (counter-clockwise) to correspond to the block 252 encoded as code 2; thereby, the processing unit 27 can compute the actual torsion value, accordingly. In addition, different amounts of torsion produce different extents of counterforce; therefore, the marking piece 25 rotates reversely in different angles, and the greater the torsion is, the more blocks 252 the marking piece 25 crosses when the marking piece 25 rotates reversely. Furthermore, it is to be noted that when the marking piece 25 has more said encode groups 251, the angle which each block 252 represents is smaller. In other words, if the marking piece 25 is divided into more regions, the processing unit 27 can compute the torsion value more accurately.

In addition, the rotating portion 222 is preferably formed with at least one first pivot portion 2221. Each hammering block 221 has at least one second pivot portion 2211 which is pivoted to one said first pivot portion 2221, and each hammering block 221 swings about each first pivot portion 2221 which severs as a center axis. In this embodiment, the rotating portion 222 is formed with two the first pivot portions 2221, the rotating assembly 21 has a main axis 211, the main axis 211 drives the rotating portion 222 and the marking piece 25 synchronously, and the main axis 211, the rotating portion 222 and the marking piece 25 are coaxially disposed. Preferably, the main body 2 is further formed with an operating region 5 which is electrically connected with the processing unit, and the operation region 5 has a display region 51 which shows the torsion value computed by the arithmetic operating unit. More preferably, the operation region 5 is further formed with an alarm device 52 (for example, an LED light, but not limited thereto) which is electrically connected with the processing unit, and the processing unit is provided for setting a preset torsion value; therefore, when the torsion value computed by the processing unit is greater than or equal to the preset torsion value, the alarm device 52 is actuated. Thereby, a driven object can be prevented from damage effectively.

Given the above, the torsion-detecting pneumatic impact tool can provide different information when the pneumatic impact tool is operated in actual practice, for example, the rotation direction, rotation speed and torsion value.

In addition, with the display region in the operating region, a user can know the torsion value timely and clearly. When different driven objects are driven, a more appropriate driving power (torsion) can be set and work with the alarm device to warm the user so as to prevent the driven object from being damaged and protect the user's safety.

While we have shown and described various embodiments in accordance with the present invention, it should be clear to those skilled in the art that further embodiments may be made without departing from the scope of the present invention.

What is claimed is:

1. A torsion-detecting pneumatic impact tool, including:

a main body, a rotating assembly and a hammering set disposed inside the main body, the hammering set having at least one hammering block and a rotating portion which is connected with each hammering block, each hammering block, the rotating portion and the rotating assembly rotating synchronously;

a transmission shaft, penetrating through each hammering block, the transmission shaft actuated intermittently by the hammering block's swing strike;

a torsion detecting unit, including a marking piece which has a plurality of blocks, at least two sensors which detect the marking piece and a processing unit which is electrically connected with each sensor, the marking piece and the rotating assembly rotating synchronously;

wherein, when each hammering block swing strikes the transmission shaft in a direction, each hammering block, the rotating portion and the marking piece slightly rotate reversely because of a counterforce of swing strike, wherein when the marking piece rotates reversely, the processing unit receives a signal of a degree of rotation of the blocks detected by the at least two sensors and computes a torsion value.

2. The torsion-detecting pneumatic impact tool of claim 1, wherein the rotating assembly has a main axis, and the main axis drives the rotating portion and the marking piece synchronously.

3. The torsion-detecting pneumatic impact tool of claim 2, wherein the main axis, the rotating portion and the marking piece are coaxially disposed.

4. The torsion-detecting pneumatic impact tool of claim 1, wherein the at least two sensors are arranged on the same radial extension line respectively relative to the marking piece.

5. The torsion-detecting pneumatic impact tool of claim 1, wherein a plurality of encode groups are annularly formed on the marking piece and repeatedly arranged along the marking piece, each encode group has a part of the blocks which are encoded in a first direction, wherein, when the marking piece rotates in a second direction, the processing unit determines whether the second direction and the first direction are the same or not according to the coding sequence the processing unit receives.

6. The torsion-detecting pneumatic impact tool of claim 1, wherein each sensor is a light sensor, and the marking piece is a grating plate.

7. The torsion-detecting pneumatic impact tool of claim 6, wherein the marking piece is formed with a plurality of through holes which partially overlap radially to define the blocks.

8. The torsion-detecting pneumatic impact tool of claim 1, wherein the main body further has an operation region which is electrically connected with the processing unit, and the operation region is formed with a display region.

9. The torsion-detecting pneumatic impact tool of claim 8, wherein the operation region is further formed with an alarm device which is electrically connected with the processing unit, the processing unit is provided for setting a preset torsion value, and when a torsion value computed by the processing unit is greater than or equal to the preset torsion value, the alarm device is driven.

10. The torsion-detecting pneumatic impact tool of claim 1, wherein the rotating portion has at least one first pivot portion, each hammering block has at least one second pivot portion which is pivoted to one said first pivot portion, and each hammering block swings about each first pivot portion which severs as a center axis.

* * * * *